US005149091A

United States Patent [19]

Okumoto et al.

[11] Patent Number: 5,149,091

[45] Date of Patent: Sep. 22, 1992

[54] GOLF CLUB HEAD

[75] Inventors: Takaharu Okumoto, Chigasaki; Tetsuya Hayashi, Hiratsuka; Masahiro Kato, Zama, all of Japan

[73] Assignee: The Yokohama Rubber Co., Ltd., Tokyo, Japan

[21] Appl. No.: 695,701

[22] Filed: May 3, 1991

[30] Foreign Application Priority Data

May 7, 1990 [JP] Japan ..... 2-117046
May 9, 1990 [JP] Japan ..... 2-117540
Jun. 6, 1990 [JP] Japan ..... 2-59193[U]
Jun. 6, 1990 [JP] Japan ..... 2-59194[U]

[51] Int. Cl.[5] ..... A63B 53/02

[52] U.S. Cl. ..... 273/80.2; 273/80.8; 273/167 R; 273/167 K; 273/DIG. 23

[58] Field of Search ..... 273/80 R-80 D, 273/80.1-80.9, 167-175, DIG. 23

[56] References Cited

U.S. PATENT DOCUMENTS 713,845 11/1902 Braid et al. ..... 273/80.6
1,249,127 12/1917 Lard ..... 273/80.3
1,480,961 1/1924 Smith ..... 273/80.2
1,501,344 7/1924 Hubbard ..... 273/80 R
1,559,299 10/1925 Barach ..... 273/80.7
1,841,062 1/1932 Schavoir ..... 273/80 R X
2,067,556 1/1937 Wettlaufer ..... 273/80.1
2,153,880 4/1939 Barnhart ..... 273/80.4
3,819,181 6/1974 Mills ..... 273/80.2
4,063,737 12/1977 Tom et al. ..... 273/80.5 X
4,854,582 8/1989 Yamada ..... 273/80.2
4,948,132 8/1990 Wharton ..... 273/80.2 X

*Primary Examiner*—Theatrice Brown
*Assistant Examiner*—Sebastiano Passaniti
*Attorney, Agent, or Firm*—Finnegan, Henderson, Farabow, Garrett & Dunner

[57] ABSTRACT

A golf club head having a channel formed in the back on the heel side of the club head main body that extends from the upper end of the hosel portion to the underside of a sole portion. A cover member molded separately is mounted over the opening of the channel to close it whereby a shaft fit hole is formed for receipt of the club's shaft by the inner surface of the cover member and a part of the inner surface of the channel.

10 Claims, 7 Drawing Sheets

GOLF CLUB HEAD

BACKGROUND OF THE INVENTION

The present invention relates to a golf club head molded from synthetic resin as a main material and a mold for the same, and more particularly to a golf club head whose shaft fit hole is able to be molded with high accuracy by using a simple mold structure and a mold for molding the same.

In prior art wood type golf club heads formed from synthetic resin as a main material, as shown in FIG. 23, a shaft fit hole 107 is provided in the heel side end portion of the club head main body 101 such that the shaft fit hole 107 extends from the upper end of the hosel portion 102 to the bottom of the sole portion 103. Generally, in molding a golf club head of this type, a mold is used which is divided into two halves; upper and lower molds, and a shaft molding pin for molding the above-mentioned shaft fit hole 107 is mounted in this mold.

However, because such a shaft molding pin is mounted therein, the mold used has to be made larger and the structure of the mold is also more complicated. In addition, the complicated structure of the mold makes it extremely difficult to set the shaft molding pin at a precise predetermined position in the mold. Due to this, deviations in the position and/or the angle of inclination of the shaft molding pin occur during the molding operation, which leads to poor quality in the golf club heads molded.

Moreover, players require various types of golf clubs having different loft angles (angles at which the club face inclines with reference to the axis of the club shaft) and lie angles (angles at which the club shaft inclines with reference to the ground when the gap between the sole portion of the club head main body and the ground at the toe end is substantially the same as the gap at the heel end). However, it is not possible to mold such various types of golf club heads using one type of a mold, and due to this, typically each club's specification require a different type of a mold. Thus many types of molds have to be prepared. This inevitably increases the manufacturing costs of golf club heads.

An object of the present invention therefore is to provide a golf club head molded from a synthetic resin as a main material whose shaft fit hole is molded through a simple mold structure without using the above-mentioned troublesome shaft molding pin.

Another object of the present invention is to provide a golf club head whose shaft fit hole is able to be molded with high accuracy.

A further object of the present invention is to make it possible to manufacture various types of golf club heads having different lie and loft angles using one type of a mold with high manufacturing efficiency.

A still further object of the present invention is to provide a mold enabling the molding of the above-mentioned golf club head in an easy fashion.

SUMMARY OF THE INVENTION

A golf club head designed to accomplish the above objects according to the present invention is characterized in that a channel is formed in the back on a heel side of a club head main body molded from synthetic resin as a main material such that the channel extends from the upper end of a hosel portion to the underside of a sole portion, and that a cover member molded separately from the club head main body is mounted on the opening of the channel so as to close the opening whereby a shaft fit hole is formed by the inner surface of the cover member and a part of the inner surface of the channel. The golf club head according to the present invention may be used not only for a wood type golf club head but also for an iron type one.

Thus, since the shaft fit hole is formed by the channel, obviating the necessity of the prior art shaft molding pin, the structure of a metal mold can be made simple. In addition, since the positional deviation and/or inclination change of the pin that would take place during a molding operation when the shaft molding pin is used can be avoided, the accuracy with which the shaft fit hole is molded can be improved.

Alternatively, a separate spacer member having a shaft fit hole therein, which is molded separately from the club head main body, may be fitted into the channel of the golf club head. Such a structure can also provide a golf club head having a shaft fit hole with high precision comparable with that of the above mentioned golf club head.

Furthermore, a mold for molding the above-described golf club head has a two-piece metal mold structure in which a molding member having an elongated projection for molding the channel is detachably or integrally provided on the molding surface of a first split mold for molding the back on the heel side from the upper end of the hosel portion to the underside of the sole portion. By using a mold structure of this type it is possible to easily mold the golf club head according to the present invention having the above-mentioned features.

DETAILED DESCRIPTION OF THE PREFERRED EMBODIMENTS

Figure 1:
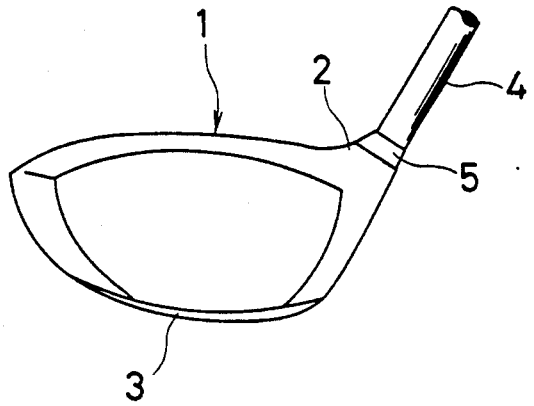
FIG. 1 is the front view showing a state in which a club shaft is mounted on a wood type golf club head according to the present invention.

In FIG. 1, in a wood type golf club head, a club shaft 4 is mounted on the end portion on the heel side of a club main body 1 such that the shaft extends from the hosel portion 2 to the sole portion 3 with a socket 5 being mounted on the upper side of the hosel portion 2.

Figure 2:
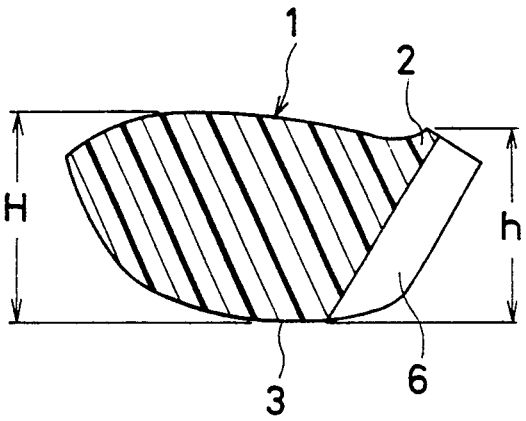
FIG. 2 is a longitudinal sectional view of the same club head.
Figure 3:
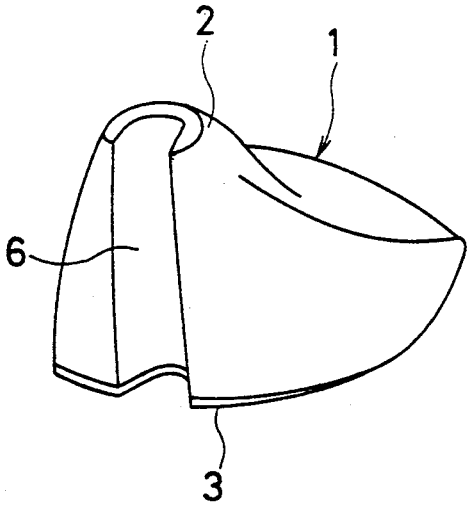
FIG. 3 is a perspective view of the same club head as viewed from the back on the heel side.
Figure 7:
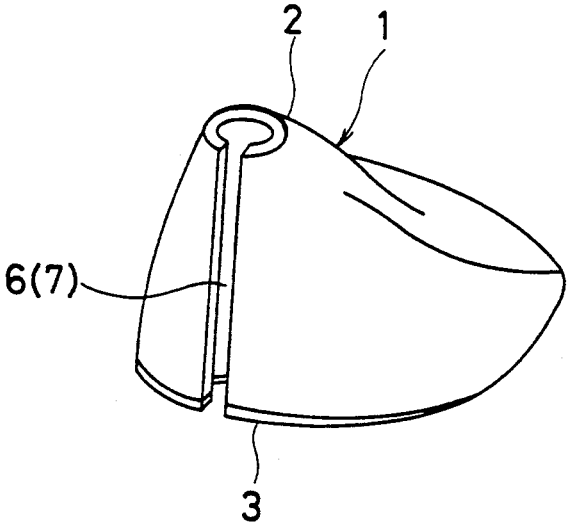
FIG. 7 is a perspective view of a wood type golf club of another embodiment as viewed from the back on the heel side.
Figure 23:
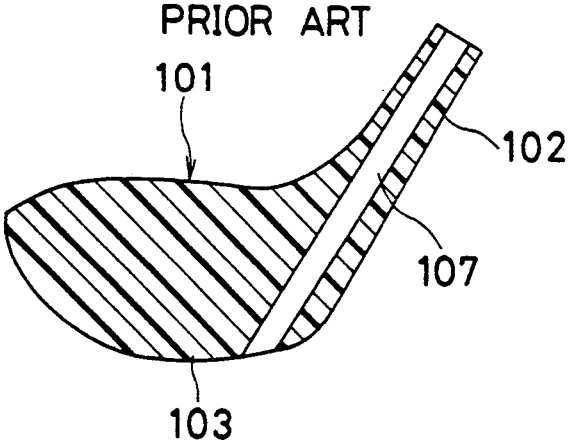
FIG. 23 PRIOR ART
FIG. 23 is a longitudinal sectional view of a prior art wood type golf club head.

The above-mentioned club head main body 1 is molded from a synthetic resin such as fiber reinforced plastic as a main material. As shown in FIGS. 2 and 3, the configuration of the club head main body 1 before the club shaft 4 is mounted is such that a linear channel 6 is provided extending from the hosel portion 2 on the back on the heel side to the sole portion. The cross-sectional configuration of this channel 6 is preferably of a U-shape as shown in FIG. 3, or of a C-shape in which the opening is made narrower as shown in FIG. 7. The hosel portion 2 of the club head shorter than that of a prior art golf club head as shown in FIG. 23, and the height h up to the top of the hosel portion of the club is set to be close to the height H of the club head main body 1.

Figure 4:
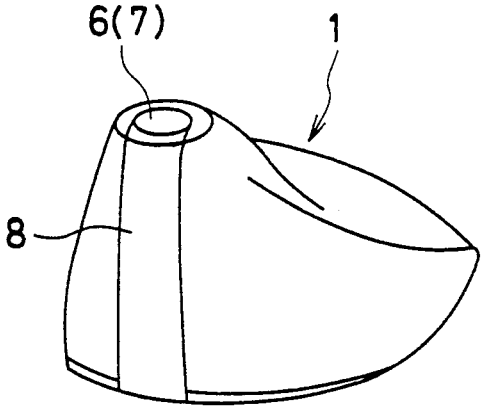
FIG. 4 is a perspective view of the same club head as viewed from the back on the heel side showing which a cover member mounted on a channel in the back on the heel side.
Figure 5:
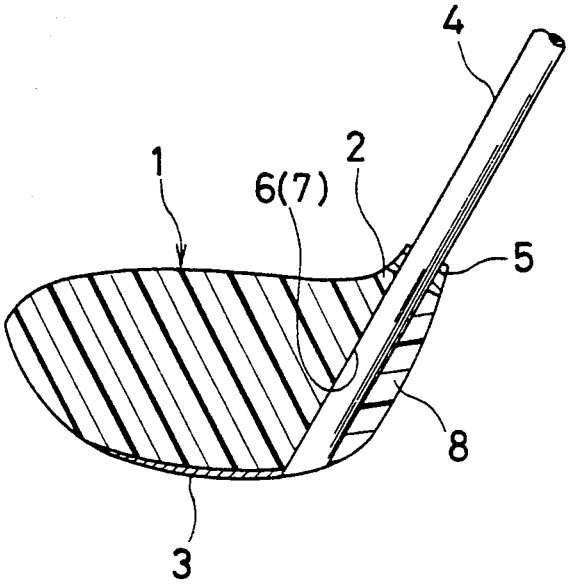
FIG. 5 is a longitudinal sectional view of the same club head in which a club shaft has been mounted.

The opening in the channel 6 formed as described above is, as shown in FIG. 4, covered with a cover member 8 molded separately from a synthetic resin as a main material whereby a shaft fit hole 7 is formed between the inner surface of the cover member 8 and the channel 6. The cover member 8 is bonded and secured with an adhesive. The club shaft 4 is inserted into the shaft fit hole 7 thus formed, and is secured in place with an adhesive. FIG. 5 shows the state in which the club shaft 4 is attached to the club head main body in this manner.

Figure 6:
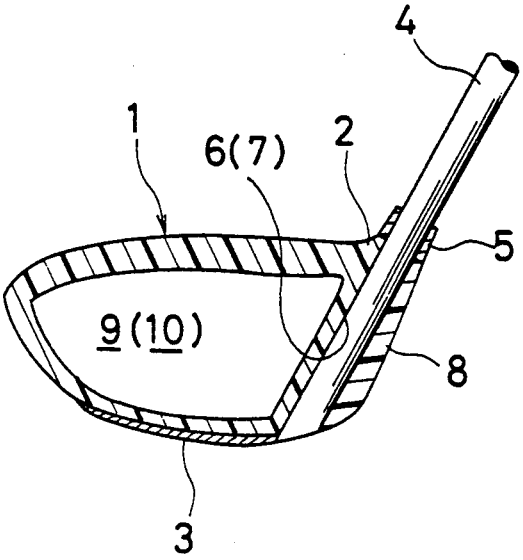
FIG. 6 is a longitudinal sectional view of a wood type golf club head of another embodiment in which a club shaft has been mounted in the same say as in FIG. 5.

When attaching the club shaft 4 to the club head main body 1, although the club shaft may be inserted into the shaft fit hole 7 after the shaft fit hole has been formed, the club shaft may be assembled to the club head main body in synchronism with the attachment of the cover member 8 to the opening in the concave channel 6. The club head main body 1 may be solid as shown in FIG. 5, or it may be formed with a hollow interior portion as shown in FIG. 6, or a core member 10 consisting of a lightweight member such as glass foam may be inserted into the hollow portion.

Thus, in the above-described club head, the shaft fit hole is not molded as a through hole from the beginning, but is formed by means of the channel 6, and this obviates the necessity of using a shaft molding pin in the metal mold, thereby making it possible to make the structure of the mold simple. In addition, since no shaft molding pin is used, there is no risk that the degree of accuracy of the shaft fit hole will be lowered due to positional deviations and/or inclination angle changes of the molding pin during the molding operation as in the case of prior art mold.

Figure 8:
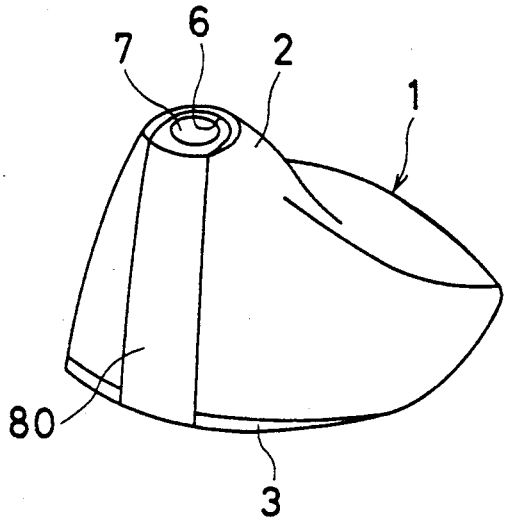
FIG. 8 is a perspective view as viewed from the back on the heel side showing a spacer member fitted into the golf club head shown in FIG. 3.
Figure 9:
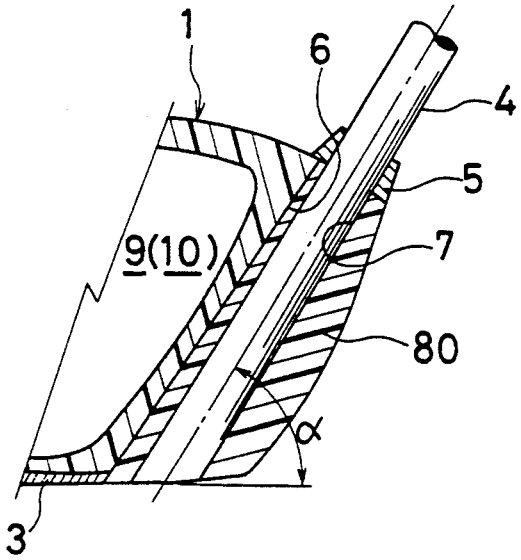
FIG. 9 is a longitudinal sectional view showing club shaft mounted in the golf club head shown in FIG. 8.
Figure 10:
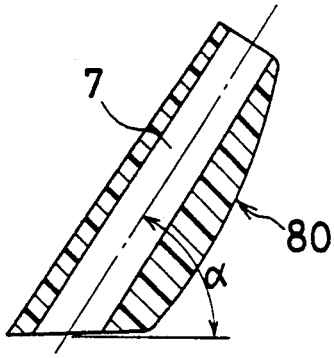
FIGS. 10 and 11 are longitudinal sectional views of different embodiments of the spacer member.
Figure 11:
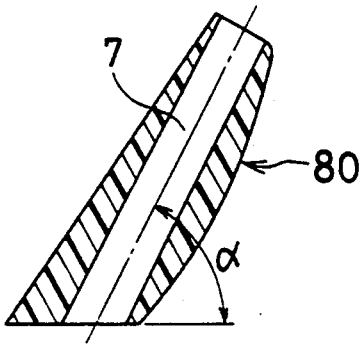

FIG. 8 shows an embodiment in which a member or insert 80 separately molded from a synthetic resin as a main material as shown in FIG. 10 is fitted into the channel 6 instead of the above-described cover member 8. The linear shaft fit hole 7 is molded in advance when the spacer member 80 is molded, and the inclination angle $\alpha$ with reference to a horizontal plane may be set to be various different magnitudes as shown in FIGS. 10 and 11. FIG. 9 shows the state in which the club shaft 4 is assembled to the golf club head shown in FIG. 8.

In this embodiment, too, as in the case with the above-described embodiment, the shaft fit hole 7 is not formed in the club head main body 1 when the head is molded, thus obviating the necessity to use a shaft molding pin. Therefore, there is no risk of the degree that accuracy of the shaft fit hole will be lowered due to positional deviations and/or inclination angle change of the molding pin. As shown in FIGS. 10 and 11, the inclination angle $\alpha$ of the shaft fit hole 7 of the spacer member 80 can be adjusted at the time of molding. Due to this, in a case where various types of golf club heads each having different lie and loft angles are manufactured, it is possible to easily manufacture club heads using one type of a mold.

Figure 12:
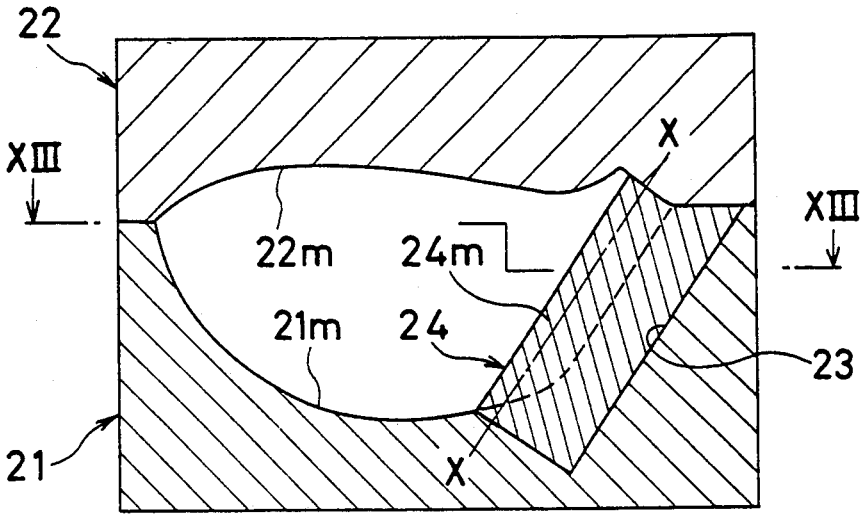
FIG. 12 is a longitudinal sectional view of a mold for a golf club head according to the present invention.
Figure 13:
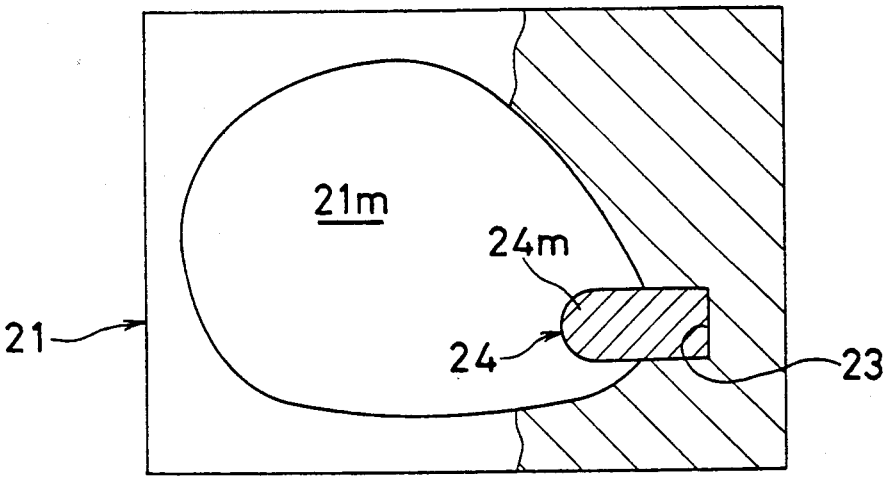
FIG. 13 is a sectional view taken along the line XIII—XIII in FIG. 12.

FIGS. 12 and 13 show as an example a mold for the afore-mentioned wood type golf club.

The mold comprises a first split mold 21 as a lower mold and a second split mold 22 as an upper mold, these first and second split molds having molding surfaces 21*m* and 22*m* for molding the club main body 1. The first split mold 21 for mainly molding the lower portions of the club main body 1 includes a molding surface for the heel side back, in which a channel 23 is provided that extends on a linear slant from the upper end to the lower end thereof, and a block-like molding member 24 is detachably mounted in this channel 23. This molding member 24 forms an elongated projecting portion projecting inwardly, and the edge portion of the elongated projecting portion 24*m* is formed into a semi-circular shape so as to mold the aforementioned channel 6 of the club head main body.

Figure 14:
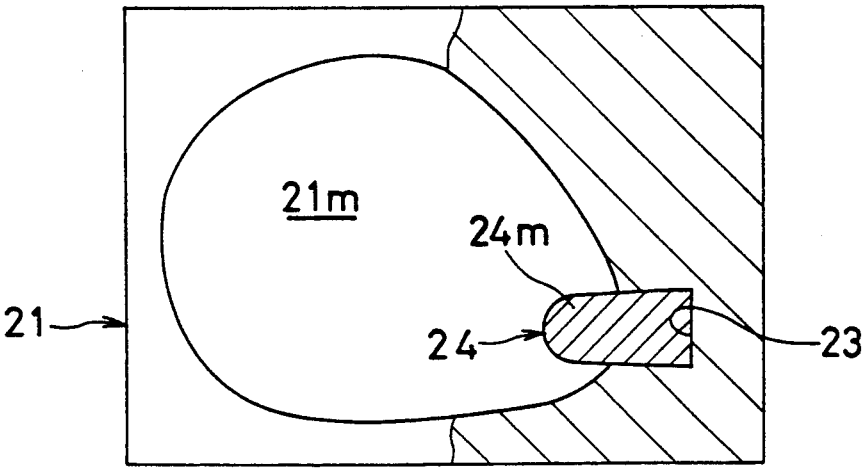
FIG. 14 is a sectional view of a mold according to another embodiment taken along the line corresponding to the one shown in FIG. 13.

In the embodiment shown in FIG. 13, the elongated projecting portion 24*m* of the molding member 24 is formed such that the left and right sides thereof are parallel to each other with a predetermined width. However, as shown in FIG. 14, the left and right sides thereof may be formed in a converging relationship toward the molding surface 21*m*. It is preferable to provide a slight withdrawing inclination on the elongated projecting portion 24*m* of this molding member 24 in order to facilitate the withdrawal of the club head main body that has been molded from the mold.

The line X—X indicated in FIG. 12 in the elongated projecting portion 24*m* indicates a position corresponding to the axis center of the shaft fit hole. In processing the molding member 24, lie and/or loft angles may be determined arbitrarily by adjusting the angle of the line X—X of this elongated projecting portion 24*m*. Therefore, it is possible to mold various types of golf club heads, with one type of a mold by using a number of different molding members 24 having different angles of the line X—X in their elongated projecting portion 24*m*.

Figure 15:
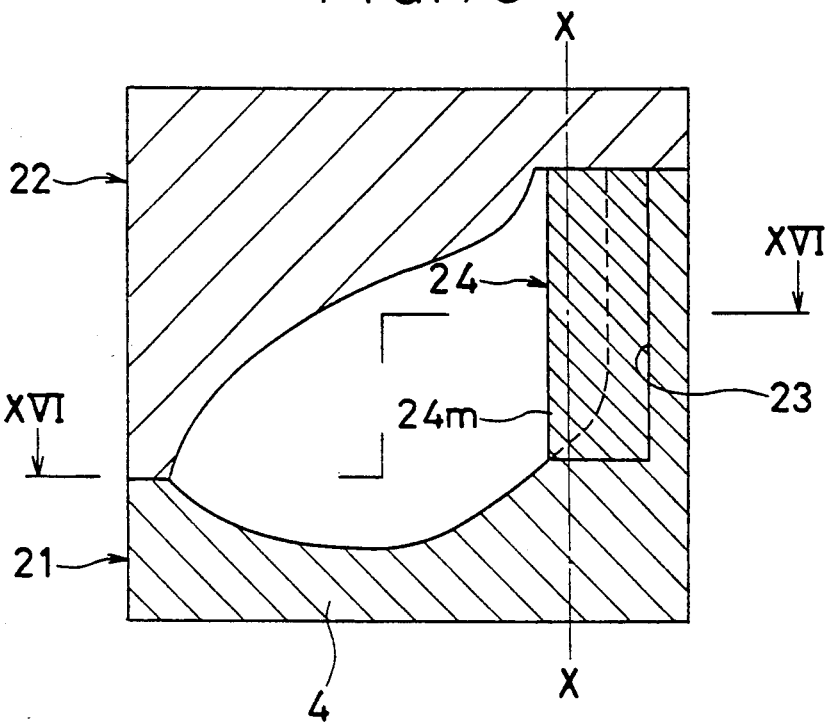
FIG. 15 is a longitudinal sectional view of a metal mold for a golf club head according to another embodiment of the present invention.
Figure 16:
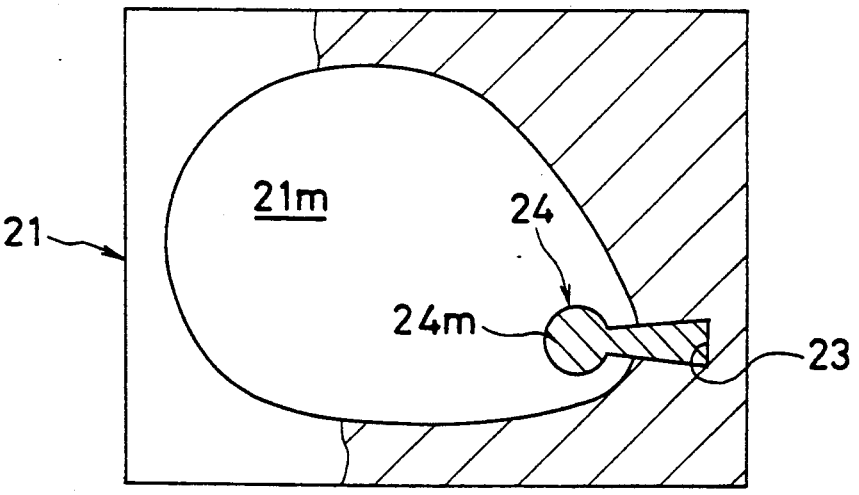
FIG. 16 is a sectional view taken along the line XVI—XVI in FIG. 15.

FIGS. 15 and 16 show a mold according to another embodiment of the present invention. In this mold, the line X—X corresponding to the axis center of the shaft fit hole is perpendicular with reference to the horizontal plane, and is advantageously used to mold a golf club head where the opening in the channel 6 is narrower than the channel (e.g. of C-shape). When the opening in the channel 6 is narrower, the golf club head that has been molded cannot be withdrawn in a direction normal to the longitudinal direction of the projecting portion 24*m*, and but it has to be longitudinally moved in parallel to it. Thus if the line X—X of the elongate projecting portion is made normal to the horizontal plane, withdrawal from the mold is not difficult.

Figure 17:
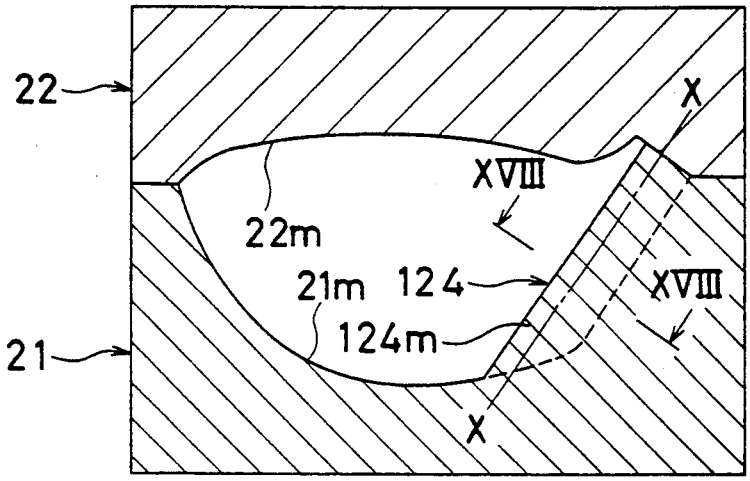
FIG. 17 is a longitudinal sectional view of a metal mold for a golf club head according to a further embodiment of the present invention.
Figure 18:
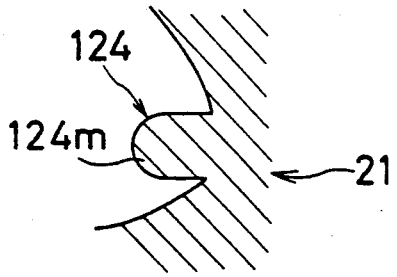
FIG. 18 is a sectional view taken along the line XVIII—XVIII in FIG. 17.

The mold shown in FIGS. 17 and 18 is an embodiment in which a molding member 124 is formed as an integral part of the molding surface 21*m* of the first split mold 21. In other words, the molding member 124 is integrally formed, which is different from the molding member 24 of the mold shown in FIGS. 12 and 13 where the molding surface 24*m* is separately formed. A mold in which the molding member 24 is formed as an integral part of the mold 21 is advantageous when trying to improve the degree of accuracy of the lie and/or loft angles of the golf club head.

Figure 19:
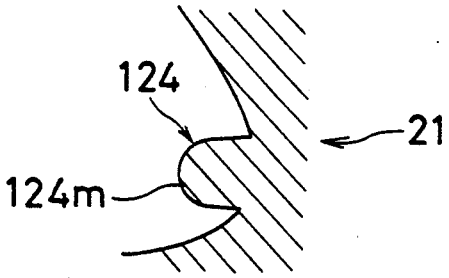
FIG. 19 is a sectional view of a mold according to another embodiment taken along the line corresponding to the one in FIG. 18.
Figure 20:
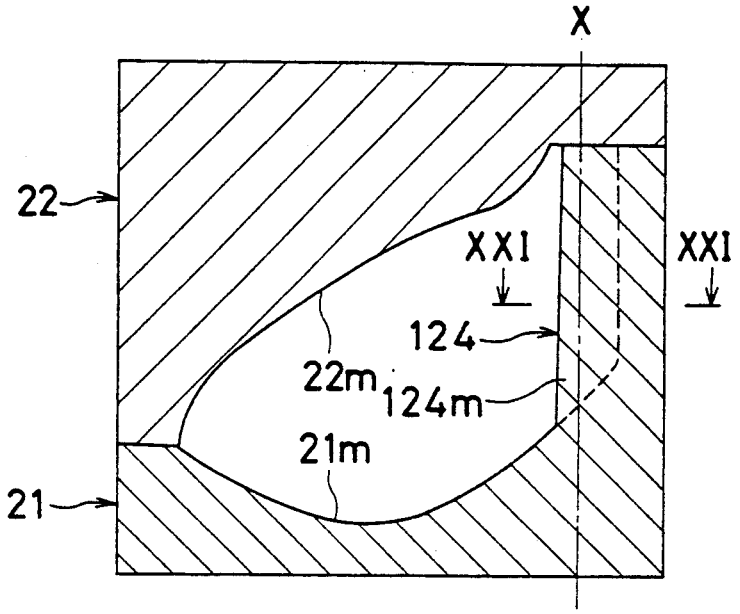
FIG. 20 is a longitudinal sectional view of a mold for a golf club head according to a further embodiment of the present invention.
Figure 21:
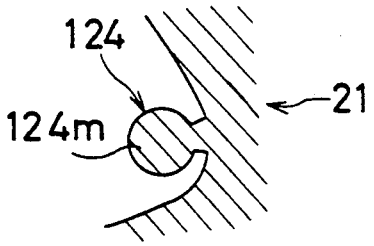
FIG. 21 is a sectional view taken along the line XXI—XXI in FIG. 20.
Figure 22:
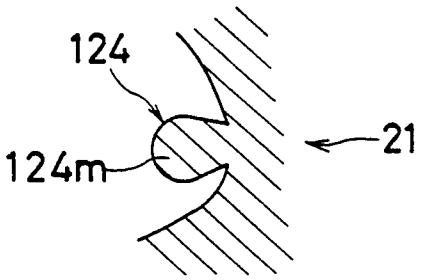
FIG. 22 is a sectional view of a mold according to a still further embodiment taken along the line corresponding to the one in FIG. 21.

Thus, even with a mold in which the molding member 124 is formed as an integral part of the molding surface 21*m*, in the case where a golf club head having a channel 6 whose opening is made narrower, it is preferable, as in the case of the metal mold shown in FIGS. 20 and 21, to set the line X—X of the elongated projecting portion 124*m* of the molding member 124 normal to the horizontal plane. The configuration of the elongated projecting portion 124*m* may be changed arbitrarily, and for instance, even the configuration shown in FIGS. 19 and 20 may be employed.

In the above embodiments, although only a wood type golf club head has been described, the present invention is applicable an iron golf club head as well.

What is claimed is:

1. A gold club head comprising a club head main body molded from a synthetic resin, said body having a heel portion having a backside, a sole portion having a bottom surface, an upper portion having a top surface and a hosel portion having an upper end located adjacent said heel portion and said upper portion, a channel in said heel portion having an opening on the backside thereof, said channel and its opening extending from the upper end of the hosel portion to the bottom surface of the sole portion and a separate cover member mountable over said opening to form, with said channel, a shaft fit hole for receiving a golf club shaft.

2. The gold club head of claim 1, wherein the height of the upper end of the hosel portion from the bottom surface of the sole portion of the club head body is approximately equal to the height of said top surface form said bottom surface.

3. The gold club head of claim 1, molded in the shape of a wood type golf club head.

4. The golf club head of claim 1, wherein the cross-sectional shape of the channel is U-shaped.

5. The golf club head of claim 1, wherein the cross-sectional shape of the channel is C-shaped.

6. A golf club head comprising a club head main body molded from a synthetic resin, said body having a heel portion having a backside, a sole portion having a bottom surface, an upper portion having a top surface and a hosel portion having an upper end located adjacent said heel portion and said upper portion, a channel in said heel portion having an opening on the backside thereof, said channel and its opening extending from the upper end of the hosel portion to the bottom surface of the sole portion and a separate spacer member having a shaft fit hole therein for receiving a golf club shaft securable in said channel and opening.

7. The golf club head of claim 6, wherein the height of the upper end of the hosel portion from the bottom surface of the sole portion of the club head body is approximately equal to the height of said top surface from said bottom surface.

8. The golf club head of claim 6, molded in the shape of a wood type golf club head.

9. The golf club head of claim 6, wherein the cross-sectional shape of the channel is U-shaped.

10. The golf club head of claim 6, wherein the cross-sectional shape of the channel is C-shaped.

* * * * *

UNITED STATES PATENT AND TRADEMARK OFFICE

CERTIFICATE OF CORRECTION

PATENT NO. : 5,149,091

DATED : September 22, 1992

INVENTOR(S) : Okumoto et al.

It is certified that error appears in the above-identified patent and that said Letters Patent is hereby corrected as shown below:

Claim 1, column 6, line 2, "gold" should read --golf--.

Claim 2, column 6, line 14, "gold" should read --golf--;

line 18, "form" should read --from--.

Claim 3, column 6, line 19, "gold" should read --golf--.

Signed and Sealed this

Fourteenth Day of December, 1993

Bruce Lehman

*Attest:*

BRUCE LEHMAN

*Attesting Officer*

*Commissioner of Patents and Trademarks*